United States Patent [19]

Michal

[11] 4,252,430

[45] Feb. 24, 1981

[54] FILM PROCESSING APPARATUS

[75] Inventor: Vratislav M. Michal, Rochester, N.Y.

[73] Assignee: Eastman Kodak Company, Rochester, N.Y.

[21] Appl. No.: 84,037

[22] Filed: Oct. 12, 1979

[51] Int. Cl.[3] ..... G03D 3/04

[52] U.S. Cl. ..... 354/322; 134/79; 134/83; 118/423

[58] Field of Search ..... 354/312, 316, 319, 320, 354/322, 329, 330, 275; 134/61, 78, 79, 83, 134, 142; 118/423

[56] References Cited

U.S. PATENT DOCUMENTS

| | | | |
|---|---|---|---|
| 1,185,191 | 5/1916 | Garland | 134/83 |
| 1,653,429 | 12/1927 | Caps | 354/322 |
| 2,142,881 | 1/1939 | Bell | 354/330 |
| 3,241,473 | 3/1966 | Hope et al. | 134/61 |
| 3,314,352 | 4/1967 | Grant | 354/322 |
| 3,353,470 | 11/1967 | Zane | 354/322 |
| 3,559,553 | 2/1971 | Buechner | 354/322 |
| 3,641,906 | 2/1972 | Orr | 134/78 |
| 3,772,980 | 11/1973 | Orr | 134/83 |
| 4,112,452 | 9/1978 | Patton | 354/330 |
| 4,112,453 | 9/1978 | Hutchison | 354/329 |
| 4,112,454 | 9/1978 | Harvey | 354/330 |
| 4,167,320 | 9/1979 | Hutchison | 354/330 |
| 4,178,091 | 12/1979 | Solomon | 134/79 |
| 4,194,822 | 3/1980 | Sethi | 354/275 |

*Primary Examiner*—L. T. Hix
*Assistant Examiner*—Alan Mathews
*Attorney, Agent, or Firm*—R. A. Fields

[57] ABSTRACT

In film processing apparatus, a series of transfer members are respectively associated with successive baths of processing solution for transporting a plurality of film discs supported on a spindle from one bath to the next bath by transferring the spindle from one transfer member to the next transfer member over each bath.

9 Claims, 4 Drawing Figures

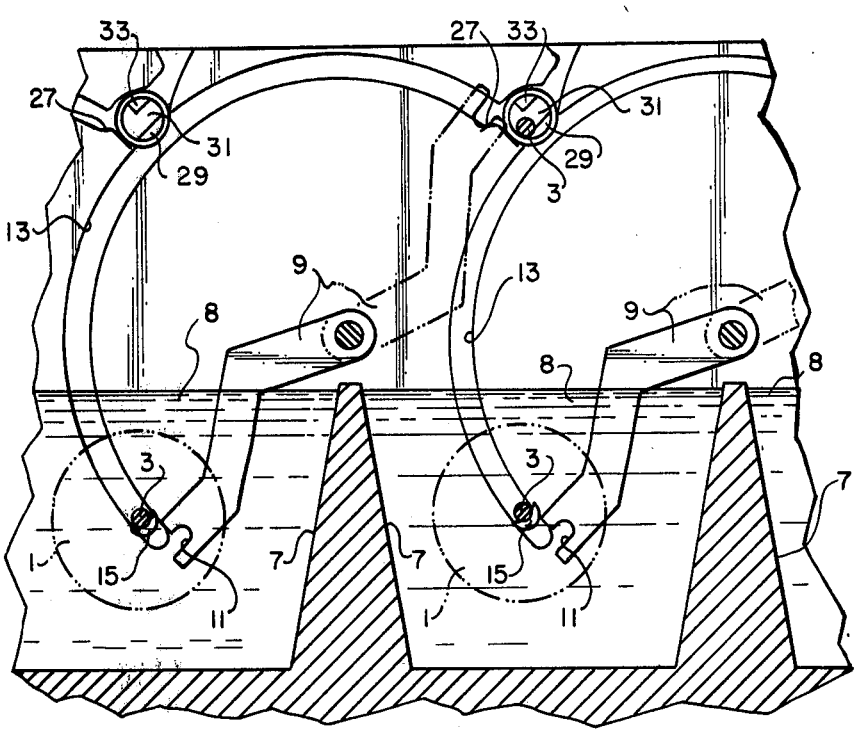
FIG. 2
FIG. 3A
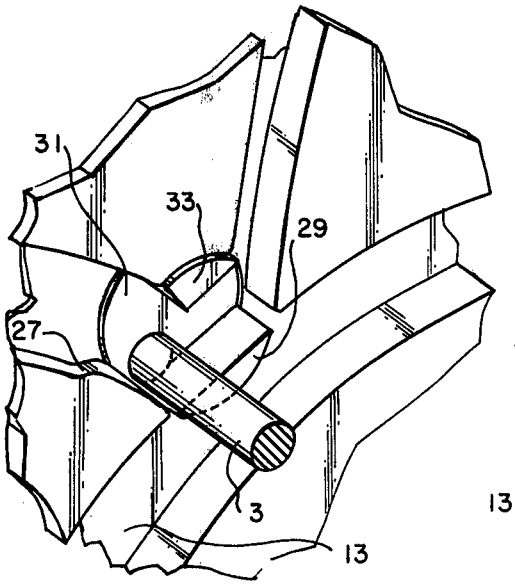
FIG. 3B
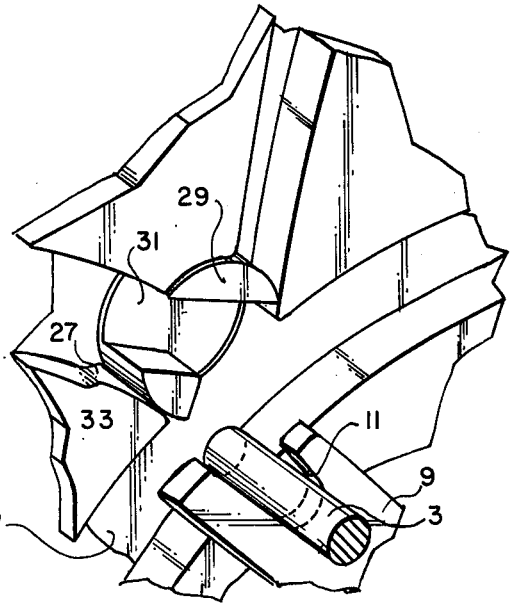

FILM PROCESSING APPARATUS

BACKGROUND OF THE INVENTION

1. Field of the Invention

The present invention relates generally to apparatus for fluid-treating photographic film having a disc-shaped configuration. More particularly, the invention relates to fluid-treating apparatus in which a plurality of film discs supported on a spindle are transported from one bath of processing solution to another for immersion in the respective baths.

2. Description of the Prior Art

A variety of devices are known for processing photographic film. Common concerns for processing film in these devices are the desire to minimize or eliminate mechanical contact with the front and back surfaces of the film and the desire to obtain an intimate contact between the film surfaces to be treated and the processing solution, without any external contaminates or any chemical carryover between different processing solutions. Further desires from the economic viewpoint are to provide processing apparatus which is low in cost, yet efficient in operation, and to minimize the quantities of solution used.

The majority of known processing apparatus has been devised for use with strip film. Although processing apparatus for strip film has been used successfully for many years, it is common in such processing apparatus for the front and back surfaces of the film to have mechanical contact with an array of drive rollers and guide rollers for transporting the film between successive baths of processing solution. As is well known, this mechanical contact can lead to problems which may affect transport time and image quality, for example.

Devices for processing discrete units of film are not as common as those for processing strip film. One possible approach is to support a plurality of film chips on a rack or in a tray and successively dip the rack or tray in different baths of processing solution. For example, U.S. Pat. No. 3,641,906, issued Feb. 15, 1972, discloses processing apparatus in which a tray of film chips suspended from a carrier rod is transported successively between baths of processing solution by respective pairs of transfer arms engagable with the carrier rod. Each pair of transfer arms is rotated 360° outside the baths, first in the initial 180° to transfer the tray of film chips from one bath to the next bath, and then in the final 180° to release the tray and return to alongside the former bath. The pairs of transfer arms are pivotally mounted between the successive baths of processing solution, which requires that the successive baths be spaced apart a sufficient distance to allow for the 360° rotation of each pair of transfer arms. This spacing apart of the successive baths, as well as the external rotation of the transfer members, adds to the overall dimensions of the processor, which increases its space requirements and possibly its cost.

More recently, discrete units of film having a disc-shaped configuration have been developed for use in a modern camera. The film disc and the camera are disclosed in commonly assigned U.S. Pat. No. 4,194,822, issued Mar. 25, 1980. The film disc has a central aperture about which is concentrically disposed a plastic hub member. The hub member is permanently attached to the film disc and includes a keyway by which the hub member can be secured to a keyed spindle for rotation of the film disc during processing. An example of a processor for the film disc is disclosed in commonly assigned U.S. Pat. No. 4,112,452, issued Sept. 5, 1978. The disclosed processor includes a keyed spindle on which a plurality of film discs can be supported in substantially parallel hub-to-hub relation. The spindle and the film discs are rotated in successive baths of processing solution and are transferred from bath to bath by respective pairs of forked lifter arms which raise a rack carrying the spindle and the film discs from one bath and lower the rack into the next bath. The pairs of lifter arms are moved outside the baths by an endless drive chain along individual rectangular paths which partially coincide alongside each bath to transfer the rack from one pair of lifter arms to the next pair.

Other examples of processors for film discs are disclosed in commonly assigned U.S. Pat. Nos. 4,112,453 and 4,112,454, both issued Sept. 5, 1978 and commonly assigned U.S. Pat. Nos. 4,178,096, issued Dec. 11, 1979 and 4,167,320, issued Sept. 11, 1979.

In summary, much of the known art which relates to processing discrete units of film discloses transfer members for transporting the film units between successive baths. These transfer members, as evidenced by the above-described prior art, move along closed or continuous paths which are located outside the baths. Such location and configuration of the respective paths adds to the overall dimensions of the processor, increasing its cost and space requirements. Several examples of the above-described prior art use a rack or a tray to successively immerse the film in different baths of processing solution. While these examples have generally performed satisfactorily, dipping the rack or the tray in the different baths increases the chemical carryover between the various solutions (which affects the quality of development) and makes access to the film units in the respective baths difficult.

SUMMARY OF THE INVENTION

The present invention is directed to an improved apparatus for processing a plurality of discrete film units which, preferably, have a disc-shaped configuration. The film discs are supported on a spindle for rotation in successive baths of processing solution and are transported along unique paths which generally occupy less space than a closed or continuous path. Moreover, the film units are immersed in the respective baths without using racks or trays, which reduces the chemical carryover between the various solutions and facilitates access to the film discs in the respective baths.

In keeping with the teachings of the present invention there is provided, in processing apparatus of the type wherein a series of transfer members are respectively associated with successive baths of processing solution for transporting spindle-supported film discs from one bath to the next by transferring the spindle from one transfer member to the next, the improvement comprising:

the transfer members each including means for releasably engaging a spindle;

means for releasing a spindle from engagement with one transfer member and for guiding the spindle into engagement with the next transfer member over each respective bath; and means mounting each transfer member for immersion (with the spindle and the film discs) in only one bath to avoid solution carryover by that transfer member between the respective baths.

The present invention provides unique features not previously available in processing apparatus. For example, the transfer members engage the spindle and are dipped with the spindle and the film discs in the respective baths. However, each transfer member is dipped only in one bath to reduce solution carryover between the respective baths.

In a preferred embodiment of the present invention there is more specifically provided the following combination:

means for advancing each transfer member forward along an individual path from within one bath to a position above the next bath and for returning the transfer member backward along the same path to the bath from which it originated;

means for releasing a spindle from engagement with a transfer member, after the transfer member is advanced to its position above the next bath, and for removing the spindle from the path of the transfer member to allow the transfer member to return along its path without the spindle; and means for holding a spindle, released above a bath from engagement with one transfer member, and guiding the spindle into engagement with the next transfer member before that member is returned to the bath.

Therefore, in the preferred embodiment, the transfer members, rather than moving in closed or continuous paths outside the baths as in the above-described prior art, move back and forth along arcuate, limited paths from within one bath to above the next bath.

According to the preferred embodiment, the means for releasing the spindle from engagement with each transfer member locates the spindle slightly above the path of the next transfer member to allow the spindle to drop into that path for engagement with the next transfer member before the next transfer member is returned to the bath from which it originated. Moreover, the spindle engaging means on each transfer member is a support saddle or open-ended slot for catching the spindle as it is dropped into the path of a transfer member.

Still other aspects of the invention and more specific features will become apparent to those skilled in the art from the following description of the preferred embodiment considered together with the accompanying drawings.

BRIEF DESCRIPTION OF THE DRAWINGS

FIG. 2 is an elevation view of a section of the processor apparatus of FIG. 1; and FIGS. 3A and 3B are perspective views of a mechanism in the processor apparatus which, in FIG. 3A, holds a spindle released from engagement with one transfer member and, in FIG. 3B, drops the spindle into engagement with the next transfer member.

DESCRIPTION OF THE PREFERRED EMBODIMENT

Figure 1:
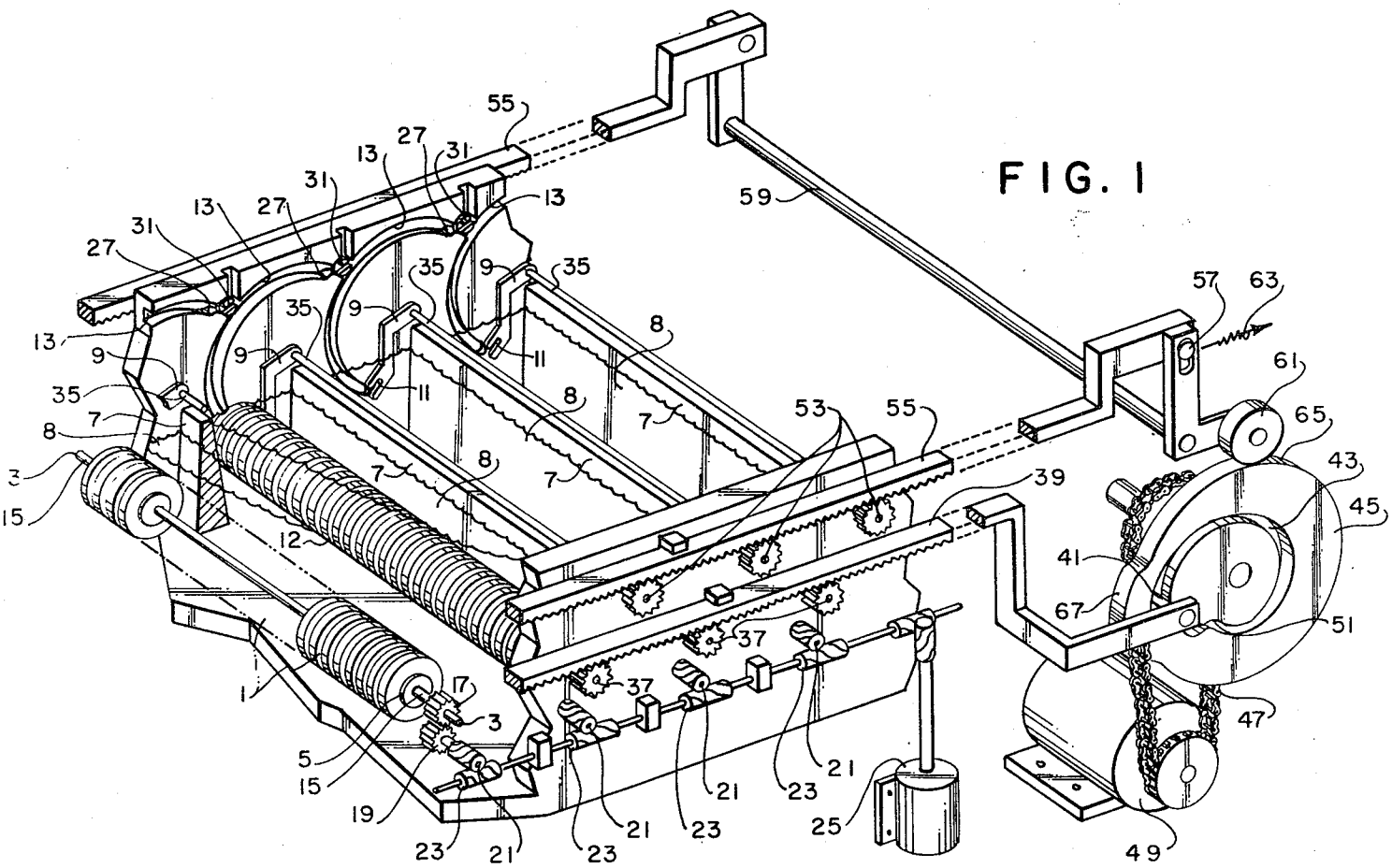
FIG. 1 is a perspective view of processing apparatus in accordance with the present invention, showing a series of pairs of transfer members respectively associated with successive baths of processing solution for transporting film discs supported on a spindle from one bath to the next bath by transferring the spindle from one pair of transfer members to the next pair.

Referring now to the drawings, apparatus is depicted in accordance with a preferred embodiment of the present invention for processing discrete units of film to establish from latent images, visually perceivable images, such as for direct viewing, projection or printing.

The processing apparatus has particular utility and will be described with film units having a disc-shaped configuration. Such film discs are illustrated and described in commonly assigned, U.S. Pat. No. 4,194,822 entitled PHOTOGRAPHIC FILM CARTRIDGE ASSEMBLY AND CAMERA, issued Mar. 25, 1980 in the name of G. S. Sethi, the disclosure of which is incorporated in the present application by reference. As there described, the film discs each include a flexible but relatively stiff support disc that is coated on one of its face surfaces with a photosensitive emulsion to define a dimensionally-stable and self-supporting annular imaging area. The support disc is fixed to a rigid center hub or core which is somewhat thicker than the support disc and includes a central aperture having a keyway for receiving a keyed spindle.

To process a plurality of film discs 1, as shown in FIG. 1, the film discs are supported in substantially parallel hub-to-hub relation on a keyed spindle 3 and the spindle and the film discs are rotated in processing solution about a common, generally horizontal axis which extends perpendicular to and axially of the film discs. A pair of circular end caps 5 (only one of which is shown in FIG. 1) hold the film discs 1 snugly together in their hub-to-hub relation during rotation. One or both of the end caps 5 are slidable along the spindle 3 to secure selected numbers of film discs on the spindle, and one of the end caps is removable from an end of the spindle to permit loading and removal of the film discs onto and from the spindle.

When held on the spindle 3, the imaging areas of the film discs 1 are slightly spaced apart, generally by the thickness of the center hubs of the film discs. Such spacing provides a compact or highly dense arrangement of film, yet maintains sufficient access to the imaging areas for processing.

As shown in FIG. 1, the processing apparatus includes a plurality of tanks or cells 7 which hold respective baths 8 of chemical processing or photographic treatment solutions (perhaps including water). The tanks 7 are arranged in-line for receiving the spindle 3 and a bank of film discs 1 in one tank after another. Appropriate replenishment pumps, solution lines, valves, temperature controls and the like are not shown in the drawings, but information regarding these items can be obtained from patents and other publications describing such hardware. Further details regarding the chemical and replenishment aspects of the processing operation can be obtained from current literature describing various processes for color film.

The intended process is carried out by immersing the spindle 3 and a bank of film discs 1 successively in the baths 8 to carry out the various fluid treatment steps which establish a visually perceivable image, such as a negative or transparency, from a latent image. Immersion of the spindle 3 and the film discs 1 in the baths 8 is accomplished by pairs of pivotally mounted transfer arms 9 which are respectively associated with the baths. Only one of the transfer arms in each pair is shown in FIG. 1. The transfer arms 9 in each pair have support saddles or open-ended slots 11 which enable them to releasably engage the spindle 3 at respective areas proximate the opposite ends of the spindle. FIGS. 1 and 2 show two spindles 3 respectively supporting banks of film discs 1 immersed in separate baths 8. To immerse the spindles and the banks of film discs in the baths, the pairs of transfer arms are pivoted in a counterclockwise direction, as viewed in FIGS. 1 and 2, to lower the spindles and the film discs into the baths. As the spindles 3 are lowered into the baths 8, the opposite ends of the spindles move along parallel spaced arcuate guide slots 13 at either side of each bath. When fully immersed in the baths 8, the respective areas of the spindles 3 proximate their opposite ends are supported for rotation in open bearings 15 within the baths and the support saddles 11 of the pairs of transfer arms 9 are separated from the spindles and located slightly below the open bearings, as shown in FIG. 2.

Rotation of the spindles 3 and the film discs 1 in the baths 8 is accomplished by rotating the spindles in the open bearings 15 in the baths. The drive means for rotating a spindle 3 is shown in FIG. 1 and includes a spur gear 17, fixed to the spindle and engagable with a spur gear 19, located in each tank 7. When a spindle 3 is seated in the open bearings 15 in a tank 7, the spur gear 17 on the spindle engages the spur gear 19 in that tank. As depicted in FIG. 1, the spur gears 19 are each connected by means of a liquid-tight connection (not shown) to helical gears 21 which are rotated by helical gears 23, driven by a unidirectional motor 25.

To raise the spindles 3 and the film discs 1 from the respective baths 8 and transport them to the next baths, the pairs of transfer arms 9 are pivoted forward in a clockwise direction, as viewed in FIG. 2, along individual arcuate paths from within the respective baths to above the next baths. During such movement, the pairs of transfer arms 9 first engage the spindles 3 at the support saddle 11 of the transfer arms. Then, the pairs of transfer arms lift the spindles 3 from the open bearings 15 in the respective baths 8. As the spindles 3 are raised by the pairs of transfer arms 9, the opposite ends of the spindles move along the arcuate guide slots 13 at either side of the baths 8. The opposite ends of the spindles 3 continue to ride along the arcuate guide slots 13 until the spindles are ejected from the support saddles 11 by stripper or lifter cams 27, located over the next baths, adjacent the respective ends of the arcuate guide slots. The transfer arms and the spindles come to rest, as shown in broken lines in FIG. 2, with the spindles against stop members 29 of rotatable gates 31, disposed next to the stripper cams 27. Resting against the stop members 29, the spindles 3 are positioned slightly above the individual paths of the pairs of transfer arms 9. The pairs of transfer arms then pivot backward in a counterclockwise direction as viewed in FIG. 2, along their individual paths from above the next baths to the respective baths from which each pair originated. Before immersing in the respective baths 8, however, the pairs of transfer arms 9 are momentarily stopped beneath the gates 31. The gates 31 are then rotated in a counterclockwise direction, as viewed in FIG. 3B, which moves the stop members 29 to allow the spindles 3 to drop into the support saddles 11 of the transfer arms 9. This completes the transfer of the spindles from one pair of transfer arms to the next pair. Actuator members 33 of the gates 29 operate to push the spindles from the gates should any of the spindles become jammed at a gate. After the pairs of transfer arms 9 receive the spindles 3, the transfer arms are immersed in the respective baths 8, lowering the spindles and the film discs until the spindles are rotationally supported in the open bearings 15.

The drive means for pivoting the pairs of transfer arms 9 and for rotating the gates 31 is shown in FIG. 1. The pairs of transfer arms 9 are respectively fixed to pivot rods 35, coupled to pinions 37 which are located along one side of the processing apparatus. The pinions 37 engage a single rack 39 which includes a follower pin 41 riding in an eccentric cam groove 43 in a cam wheel 45. The cam wheel 45 is rotated in a counterclockwise direction, as viewed in FIG. 1, by a chain drive 47, driven by a unidirectional motor 49. Rotation of the cam wheel 45 causes the rack 39 to reciprocate back and forth in a straight line. The rack 39 first reciprocates to the right, in FIG. 1, which rotates the pinions 37 and the transfer arms 9 in a clockwise direction, raising the transfer arms out of the respective baths 8. The rack then reciprocates to the left, in FIG. 1, which rotates the pinions and the transfer arms in a counterclockwise direction, returning the transfer arms back to the respective baths. A dwell or recess 51 in the cam groove 43 operates to momentarily halt movement of the rack 39 to the left, which momentarily stops pivoting of the transfer arms 9 in a counterclockwise direction beneath the gates 31, as shown in FIG. 3B. Then, rotation of the gates 31 in a counterclockwise direction, as viewed in FIGS. 1 and 3B, to allow the spindles 3 to drop into the support saddles 11 of the transfer arms 9, is accomplished by similarly rotating pinions 53, secured to the gates. The pinions 53 engage either of two racks 55 which are connected by pin-in-slot connections 57 to a pivot rod 59. The pivot rod 59 is pivoted by the action of a follower wheel 61, urged by a spring 63 to ride along the peripheral edge 65 of the cam wheel 45. When a hump or raised portion 67 on the wheel edge 65 is rotated into contact with the follower wheel 61, the racks 55 are reciprocated first to the left, in FIG. 1, which rotates the pinions 53 and the gates 31 in a counterclockwise direction. Then, the action of the spring 63 reciprocates the rack 55 to the right, in FIG. 1, which rotates the pinions 53 and the gates 31 in a clockwise direction.

It should now be apparent that the present invention provides unique structure not previously available in processing apparatus. The pairs of transfer arms 9 operate to transfer a spindle 3 with a bank of film discs 1 from one bath of processing solution to the next bath by transferring the spindle from one pair of transfer arms to the next pair. Such transfer is accomplished without the use of racks or trays for carrying the film discs as in the above-described prior art. Moreover, each pair of the transfer arms is only immersed in a single bath, which reduces the solution carryover between the respective baths.

The invention has been described in detail with particular reference to the preferred embodiment thereof, but it will be understood that variations and modifications can be effected within the spirit and scope of the invention.

I claim:

1. In film processing apparatus of the type wherein a series of transfer members are respectively associated with successive baths of processing solution for transporting a plurality of film discs supported on a spindle from one bath to the next bath by transferring the spindle from one transfer member to the next transfer member, the improvement comprising:

said transfer members each including means for releasably engaging a spindle;

means for releasing a spindle from engagement with one transfer member and for guiding the spindle into engagement with the next transfer member above each respective bath; and means mounting each transfer member for immersion with an engaged spindle in only one bath to avoid solution carryover by said transfer member between the respective baths.

2. In film processing apparatus of the type wherein a series of transfer members are respectively associated with successive baths of processing solution for transporting a plurality of film discs supported on a spindle from one bath to the next bath by transferring the spindle from one transfer member to the next transfer member, the improvement comprising:

said transfer members each including means for releasably engaging a spindle;

means for advancing each transfer member forward along an individual path from within one bath to a position above the next bath and for returning said transfer member backward along the same path to the bath from which it originated;

means for releasing a spindle from engagement with a transfer member after the transfer member is advanced to said position above the next bath; and means for holding a spindle released above a bath from engagement with one transfer member and for guiding the spindle into engagement with the next transfer member before said next transfer member is returned to the bath.

3. The improvement as recited in claim 2, wherein said spindle engaging means is a support saddle disposed on each of said transfer members for receiving an end of the spindle, and wherein said spindle releasing means is a plurality of cams respectively located adjacent the individual paths of said transfer members for ejecting the spindle end from said support saddles.

4. In film processing apparatus of the type wherein a series of transfer members are respectively associated with successive baths of processing solution for transporting a plurality of film discs supported on a spindle from one bath to the next bath by transferring the spindle from one transfer member to the next transfer member, the improvement comprising:

said transfer members each including means for releasably engaging a spindle;

means for advancing each transfer member forward along an individual path from within one bath to a position above the next bath and for returning said transfer member backward along the same path to the bath from which it originated;

means for releasing a spindle from engagement with a transfer member after the transfer member is advanced to said position above the next bath and for removing the spindle from the path of the transfer member to allow the transfer member to return along its path without the spindle; and means for holding a spindle released above a bath from engagement with one transfer member and for guiding the spindle into engagement with the next transfer member before said next transfer member is returned to the bath.

5. The improvement as recited in claim 4, wherein said spindle releasing means locates the spindle slightly above the path of the next transfer member to allow the spindle to drop into that path for engagement with said next transfer member.

6. In film processing apparatus of the type wherein a series of transfer members are respectively associated with successive baths of processing solution for transporting a plurality of film discs supported on a spindle from one bath to the next bath by transferring the spindle from one transfer member to the next transfer member, the improvement comprising:

said transfer members each including means for releasably engaging a spindle;

means for pivoting each transfer member forward along an individual arcuate path from within one bath to a position above the next bath and for pivoting said transfer member backward along the same arcuate path to the bath from which it originated;

cam means located over the baths, adjacent the individual paths, for releasing a spindle from engagement with each transfer member; and means for holding a spindle released from engagement with one transfer member and for guiding the spindle into engagement with the next transfer member.

7. The improvement as recited in claim 6, wherein said cam means raises a spindle from the individual path of each transfer member and locates the spindle slightly above the path of the next transfer member to allow the spindle to drop into the path of said next transfer member.

8. The improvement as recited in claim 7, wherein said spindle holding means includes means for dropping a spindle as the next transfer member is pivoted below the spindle.

9. The improvement as recited in claim 8, wherein said spindle engaging means is a slot in each of said transfer members for catching a spindle dropped from said spindle holding means.

* * * * *